United States Patent [19]

Daly

[11] 4,137,581

[45] Feb. 6, 1979

[54] ROLLOVER STRETCHER

[76] Inventor: Betty M. Daly, Box 108 115 Lake Dr., Broadway, N.C. 27505

[21] Appl. No.: 807,792

[22] Filed: Jun. 20, 1977

[51] Int. Cl.[2] ..... A61G 1/00; A61G 7/06

[52] U.S. Cl. ..... 5/82 R; 5/81 B

[58] Field of Search ..... 5/81 B, 82 R, 82 B, 5/184, 186 R, 202, 81 R

[56] References Cited

U.S. PATENT DOCUMENTS

| | | | |
|---|---|---|---|
| 2,503,314 | 4/1950 | Atwood | 5/82 |
| 2,565,761 | 8/1951 | Dean | 5/81 B |
| 3,099,020 | 7/1963 | Garfield et al. | 5/81 B |
| 3,786,523 | 1/1974 | Sele | 5/81 B |

FOREIGN PATENT DOCUMENTS

| | | | |
|---|---|---|---|
| 1194955 | 11/1959 | France | 5/81 B |

*Primary Examiner*—Mervin Stein
*Assistant Examiner*—Alex Grosz
*Attorney, Agent, or Firm*—Howard I. Podell

[57] ABSTRACT

A stretcher for handling and carrying patients is constructed with a set of two frames, which consists of a carrying frame and an auxiliary frame, with the frames capable of being drawn in and out of each other sideways relatively to each other.

2 Claims, 9 Drawing Figures

ROLLOVER STRETCHER

SUMMARY OF THE INVENTION

The objective of the invention is to provide a stretcher for the handling of patients which would avoid jerk movements caused by lifting the body of a patient. The invention achieves this objective by providing for sliding motion of the stretcher components, and by building the stretcher with two frames, of which the main frame carries the patient, and an auxiliary frame allows a sideways sliding motion of the main frame relative to the auxiliary frame, utilizing hollow beam construction and internally placed wheels.

BRIEF DESCRIPTION OF THE DRAWINGS

The objects and features of the invention may be understood with reference to the following detailed description of the invention, taken together with the accompanying drawings in which.

DESCRIPTION OF THE PREFERRED EMBODIMENT

Figure 1:
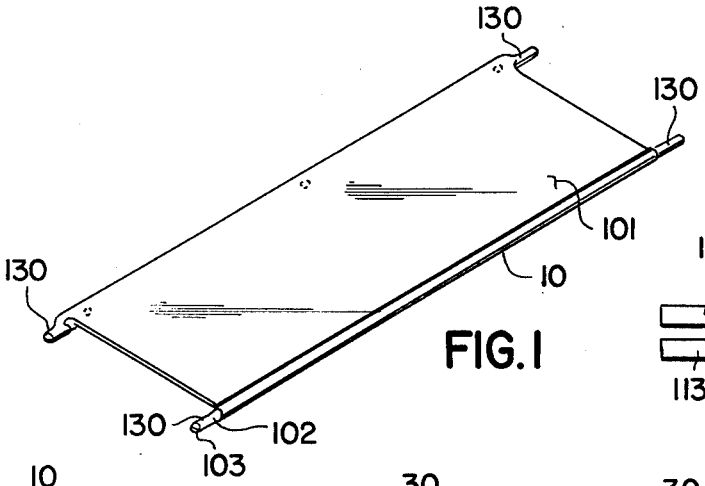
FIG. 1 is a general view of the invention in isometric projection.

Turning now descriptively to the drawings, in which similar reference characters denote similar elements throughout the several views, FIG. 1 illustrates the stretcher 10 of the invention shown in its "closed" position. Thus, panel 101, on which a patient is placed, can be made from any suitable material, such as aluminum, stainless steel, plastic sheet padded with washable material, so as to hold the spine and limbs of a patient firmly in place.

Panel 101 is suspended from two spaced longitudinal members 120 and 121 of a frame 102, joined by cross-bars 601, 602 with each longitudinal member 120, 121 extending beyond the panel to form handle segments 123 and 124 respectively.

A lower frame 103 is slidably mounted to cross bars 601 and 602 of upper frame 102, with lower frame 103 formed of two spaced longitudinal members 110 and 111 joined by cross bars 603, 604 that each extend the length of members 120 and 121 to form handle segments 113 and 114 respectively.

Frames 102 and 103 are of similar widths so that in the closed position shown in FIG. 1 the handle segments 123, 124 of each frame overlap the other to form sets of composite grips 130.

Cross bars 602 and 601 are of hollow rectangular cross-section with an open groove 620 in the bottom of each cross bar, with cross bars 603, 604 in the form of an angle fixed by a bracket section 621 passing through groove 620 to the spaced longitudinal frame members 110 and 111 of lower frame 103.

A wheel 50 is rotatably mounted to a pin 51 fixed to a side wall of each cross bar 602, 601 and located to ride on the flange section 57 of a cross bar 603 or 604.

A wheel 67 is rotatably mounted on a pin 68 fixed to the leg section 58 of each cross bar 603, 604 so as to ride on the bottom sections of a cross bar 602 or 601 respectively.

Figure 9:
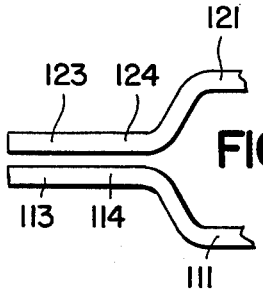
FIG. 9 is a detail side view of the handle structure.

As shown in FIG. 9, the end sections 123, 124 of each longitudinal member 120 and 121 respectively is bent so as to lie adjacent to the associated bent end section 113, 114 of a longitudinal member 110, 111.

The mode of employment of the rollover stretcher 10 as shown in FIGS. 2, 3, 4, and 5, is illustrated by its use in transferral of a patient 20 from an operating table 30, or a similar surface, onto a separate rollable table 40, and consists of the following steps.

Figure 2:
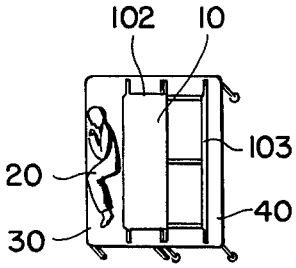
FIGS. 2–5 are perspective views that illustrate the method of utilization of the invention.
Figure 3:
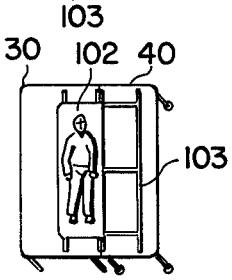

As shown in FIG. 2, a patient 20 is lying on a bed or operating table 30 adjacent to a rollable platform 40 of the height of table 30. The stretcher 10 is opened and as shown in FIG. 2, the patient is rolled onto the panel 101 which extends over table 30 while the lower frame rests on platform 40.

Figure 4:
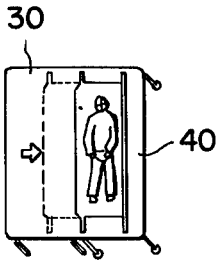
Figure 5:
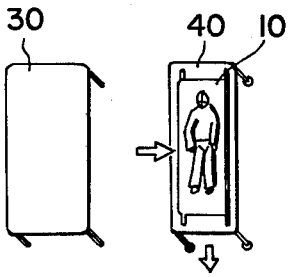
Figure 6:
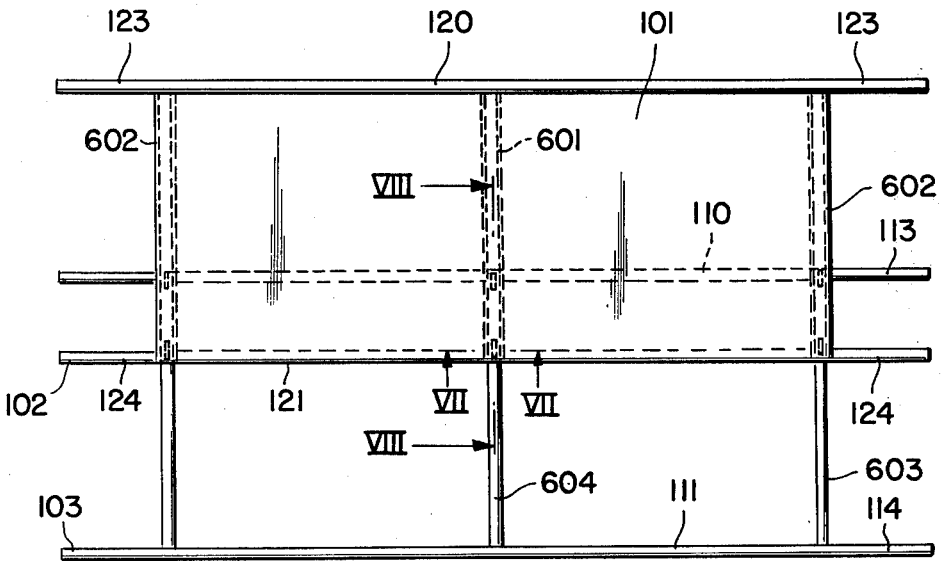
FIG. 6 is a plan view of the invention.
Figure 7:
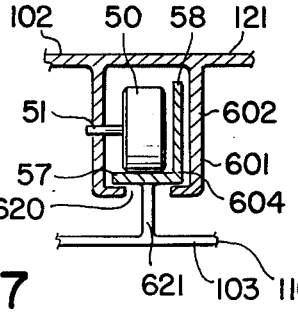
FIG. 7 is a section view taken along line VII—VII of FIG. 6.
Figure 8:
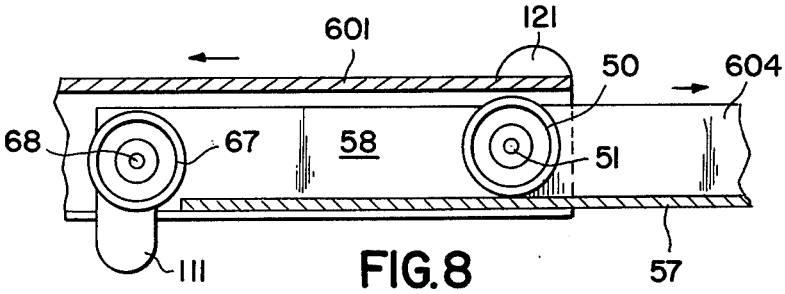
FIG. 8 is a section view taken along line VIII—VIII of FIG. 6.

The upper frame is now slid onto the lower frame resting on table 40, as shown in FIG. 4 and the table 40 may now be rolled with the patient away from table 30.

Alternately, in the open position of the assembly, the frames 102 and 103 may be completely separated so that the patient lying on panel 101 of frame 102 may be transferred to an operating table 30 with lower frame 103 resting on platform 40 rolled away from the operating table 30 during the operation period. The roll-over feature may be employed to transfer with either a right-to-left or a left-to-right direction of transfer.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. In a stretcher for handling patients, said stretcher having a supporting panel mounted on a main frame, said main frame having a first set of cross-members,
   - an auxiliary frame, formed of two spaced longitudinal members joined by a second set of cross-members,
   - with each of the first set of cross-members slidably joined to an individual cross-member of the second set of cross-members, so that the auxiliary frame may be slid sideways in relation to the main frame,
   - with the said main frame and the said auxiliary frame each shaped so as to freely rest in the open assembly position on surfaces of a substantially common horizontal plane, such that in a closed assembly position, the main frame extends directly over the auxiliary frame, while in an open assembly position, the main frame extends alongside of the auxiliary frame and such that in the open assembly position the main frame can be freely rested directly upon a first bed while the auxiliary frame is freely rested directly upon a second bed, of the general height of the first bed, with the device in the closed assembly position serving as a hand-held stretcher, in which
   - the main frame is formed of a pair of spaced longitudinal members mounted to the panel with each said longitudinal member extending beyond each opposed end of the panel to form a handle, with
   - the longitudinal members of the auxiliary frame spaced so as to each align adjacent a longitudinal member of the main frame in the closed assembly position.

2. The combination as recited in claim 1 in which each longitudinal member of both frames are of the same general length, with the end sections of each longitudinal member formed to lie adjacent one end section of the longitudinal member of the other frame, in the closed assembly position, so that each pair of two such adjacent end sections form a composite handle grip.

* * * * *